United States Patent [19]

Kuroki et al.

[11] Patent Number: 4,891,776

[45] Date of Patent: Jan. 2, 1990

[54] ELECTRONIC TIMEPIECE

[75] Inventors: Yasuo Kuroki; Fusao Suga, both of Tokyo, Japan

[73] Assignee: Casio Computer Co., Ltd., Tokyo, Japan

[21] Appl. No.: 81,324

[22] Filed: Aug. 3, 1987

[30] Foreign Application Priority Data

Aug. 15, 1986 [JP] Japan ..... 61-125226[U]
Aug. 15, 1986 [JP] Japan ..... 61-125227[U]

[51] Int. Cl.[4] ..... G04B 47/00; G10L 3/02

[52] U.S. Cl. ..... 364/705.07; 368/10; 381/53

[58] Field of Search ..... 364/705, 705.06–705.08, 364/709.01, 709.11; 387/53; 368/10, 41–44

[56] References Cited

U.S. PATENT DOCUMENTS

| | | | |
|---|---|---|---|
| Re. 32,655 | 4/1988 | Levine | 364/705 |
| 3,998,045 | 12/1976 | Lester | 381/53 |
| 4,117,542 | 9/1978 | Klausner et al. | 364/705.06 |
| 4,162,610 | 7/1979 | Levine | 364/705 |
| 4,266,096 | 5/1981 | Inoue et al. | 381/53 |
| 4,267,577 | 5/1981 | Hashimoto et al. | 364/705 |
| 4,354,260 | 10/1982 | Planzo | 368/43 |
| 4,602,347 | 7/1986 | Koyama | 364/705 |
| 4,715,010 | 12/1987 | Inoue et al. | 364/705 |
| 4,748,574 | 5/1988 | Tuchto | 364/705 |

OTHER PUBLICATIONS

Hubbard, H. P., "Personal Computer", *IBM Technical Disclosure Bulletin,* vol. 19, #7, pp. 2419–2423.

*Primary Examiner*—Gary V. Harkcom
*Assistant Examiner*—Dale M. Shaw
*Attorney, Agent, or Firm*—Frishauf, Holtz, Goodman & Woodward

[57] ABSTRACT

An electronic timepiece comprises time count circuit for counting a reference signal to obtain present time data, item data storage for storing a plurality of item data, and external operation switch for inputting at least one of alarm time data and identification data corresponding to the plurality of item data stored in the item data storage. An alarm data storage stores the alarm time data and the identification data input by the external operation switch. A read controller detects a coincidence between the present time data obtained by the time count circuit and the alarm time data stored in the alarm time data storage and for reading out, from the item data storage, item data corresponding to the identification data stored in the alarm time data storage. A display displays the item data read out by the read controller.

6 Claims, 11 Drawing Sheets

| DA | DB | | |
|---|---|---|---|
| SUGA | 0425 | 43 | 0054 |
| ORII | 03 | 783 | 3980 |
| TAGI | 0422 | 17 | 6812 |
| HARA | 0552 | 22 | 2204 |
| | | | |
| P | | | |

8

FIG. 7

| TI | MONTH | DAY | HOUR | MINUTE | PAGE NO. |
|---|---|---|---|---|---|
| | TA | | | | TB |

FIG. 8

ELECTRONIC TIMEPIECE

BACKGROUND OF THE INVENTION

The present invention relates to an electronic timepiece which comprises a data memory for storing data such as a telephone number, schedule, comment, and the like, and also has an alarm function for alarming the presence of data such as schedule, comment, and the like stored in the data memory at a preset time.

In recent years, an electronic timepiece has a large number of functions in addition to a time display function for displaying a present time.

For example, U.S. Patent Application Ser. No. 711,033 now U.S. Pat. No. 4,571,668; previously filed by the present applicant discloses an electronic timepiece which has a data memory function for storing data, such as a name, telephone number, and the like and for selectively displaying the storage data upon switching operation..

U.S. Patent Application Ser. No. 896,623 now U.S. Pat. No. 4,780,839 or U.S. Pat. Nos. 4,274,146 and 4,276,541 disclose an electronic timepiece which comprises a memory for storing a task to be performed at an alarm time or a memory for storing schedules, such as a memorial day, scheduled date, and the like, and displays the task or the schedule when the present time or date coincides with the alarm time, the memorial day, or the scheduled date.

The electronic timepieces described above has an alarm time storage area for storing an alarm time or a scheduled date and a comment data storage area for storing comment data such as a task to be performed or schedule at the alarm time or the scheduled date as a memory. When the present time or date coincides with the alarm time stored in the alarm time storage area, the comment data stored in the comment data storage area is read out and displayed.

However, in the conventional electronic timepiece, the comment data storage area must be arranged in addition to the alarm time storage area, and hence, the memory capacity must be increased. Each time the alarm time or scheduled date is set, comment data such as a task to be performed or schedule must also be set, and this results in a very cumbersome switching operation.

Another electronic timepiece is known which has a so-called data memorandum function for storing names and telephone numbers of a large number of persons and selectively displaying a name and telephone number of a desired person upon switching operation. In this electronic timepiece, only alarm time data can be stored. When the present time coincides with the alarm time and an alarm sound is produced, a data memorandum mode is selected by switching operation, and memorandum data stored in a data storage area (data corresponding to alarm time) can be searched. For example, when a user must call a specific person at a predetermined time, a time of calling is set as an alarm time. When alarming is performed at the preset alarm time, the data memorandum mode is selected to confirm a name and telephone number of the person to be called. Thus, data in the data storage area can be searched to know its content. However, with this method, a user must remember the task at the alarm time. Even if he remembers some tasks, he may not immediately remember the corresponding task upon being alarmed, and he must then search corresponding data in the data storage area by himself. For this reason, it takes a time to know the content of the memorandum data, and an operation therefor is cumbersome.

SUMMARY OF THE INVENTION

The present invention has been made in consideration of the above situation, and has as its object to provide an electronic timepiece wherein when alarming is performed at an alarm time, memorandum data associated with the alarming is automatically displayed without a special operation, and its content can be easily known.

In order to achieve the above object, there is provided an electronic timepiece comprising:

time count means for counting a reference signal to obtain present time data; itedata storage means for storing a plurality of item data; external operation switch means for inputting at least one of alarm time data and identification data corresponding to the plurality of item data stored in said item data storage means; alarm data storage means for storing the alarm time data and the identification data input by said external operation switch means; read control means for detecting a coincidence between the present time data obtained by said time count means and the alarm time data stored in said alarm time data storage means and for reading out, from said item data storage means, item data corresponding to the identification data stored in said alarm time data storage means; and display means for displaying the item data read out by said read control means. With this arrangement, according to the electronic timepiece of the present invention, a task to be performed at an alarm time or a comment can be set by a simple switching operation. When an alarm time is reached, a content corresponding to the alarming can be quickly known. Therefore, no memory for storing all the comments in correspondence with an alarm time memory is required, and a circuit can be simplified.

BRIEF DESCRIPTION OF THE DRAWINGS

FIG. 7 is a map showing an example of a storage content of RAM 8 according to another embodiment of the present invention;

FIG. 8 is a map showing an example of a storage content of an alarm time register according to the second embodiment;

DETAILED DESCRIPTION OF THE PREFERRED EMBODIMENTS

An embodiment of the present invention will now be described with reference to the accompanying drawings.

Figure 1:
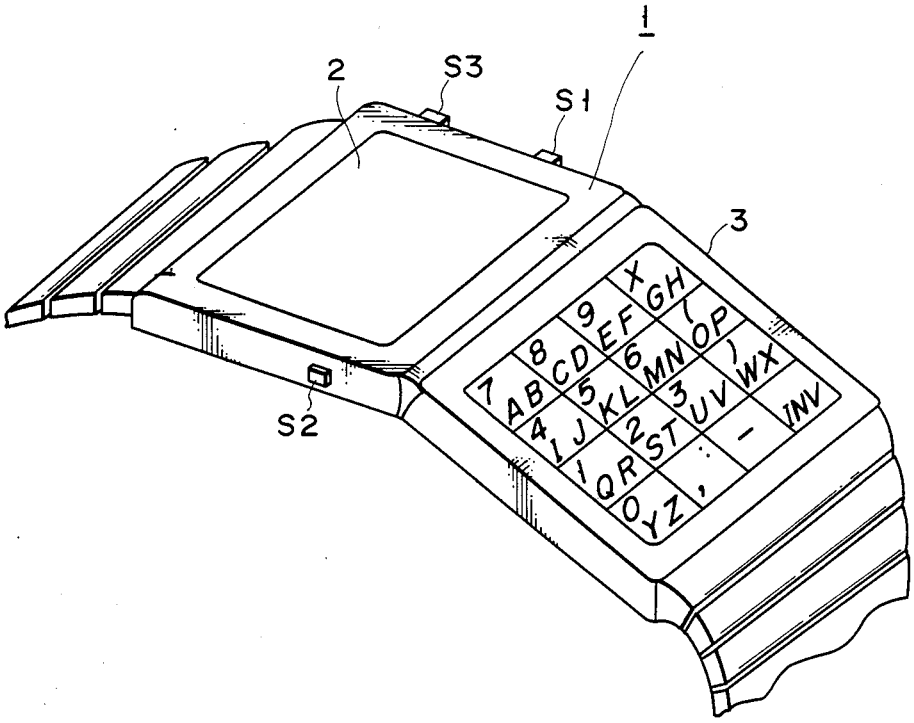
FIG. 1 is a perspective view showing the outer appearance of an electronic timepiece according to an embodiment of, the present invention.

FIG. 1 is a perspective view showing an electronic timepiece such as a wrist watch according to an embodiment of the present invention. Referring to FIG. 1, reference numeral 1 denotes a timepiece body. Timepiece body 1 comprises display section 2 such as a liquid crystal display device, for various display operations, push-button key switches S1 to S3 for various operations, and keyboard switch group 3 for a data input operation. Display section 2 comprises a liquid crystal display device capable of displaying letters, numerals, symbols, and the like. Key switch S1 has a function for switching a display mode upon its operation. Key switch S2 has a function for sequentially displaying alarm time data or a content of storage area data upon its operation. Key switch S3 has a function for resuming a time display mode and for selecting digits.

Figure 2:
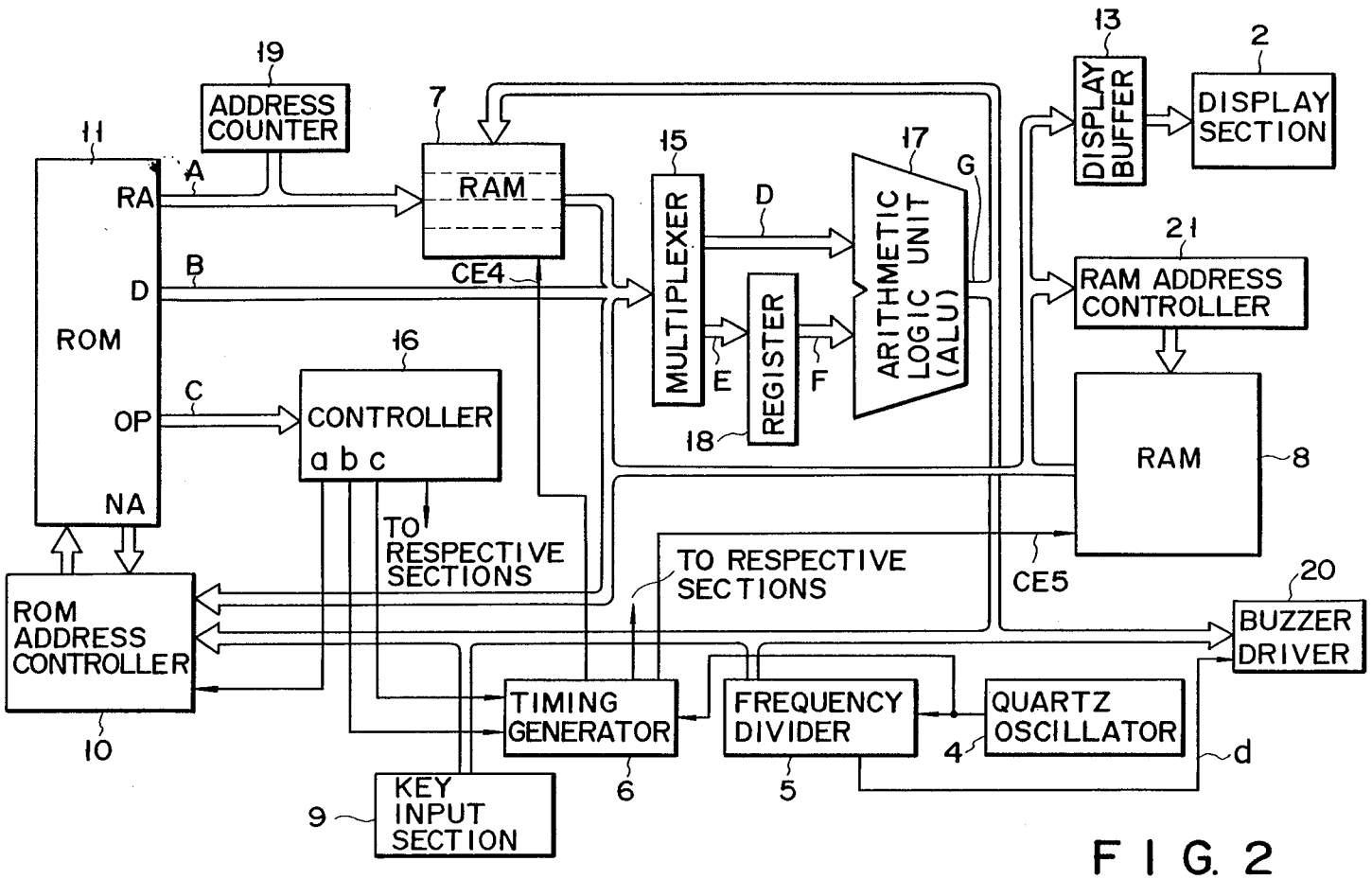
FIG. 2 is a block diagram showing an internal circuit arrangement of the electronic timepiece shown in FIG. 1.

FIG. 2 is a block diagram showing an internal circuit arrangement of this embodiment. Referring to FIG. 2, reference numeral 4 denotes a quartz oscillator for generating a clock signal of a fundamental frequency. The clock signal output from oscillator 4 is sent to frequency divider 5 and timing generator 6. Frequency divider 5 frequency-divides the clock signal of the fundamental frequency sent from oscillator 4 and outputs a timepiece signal of a predetermined cycle and a buzzer drive signal for driving a buzzer. The time signal is used for time counting processing (to be described later) for obtaining time data. The buzzer drive signal is sent to buzzer driver 20 and is used for generating a buzzer sound. Timing generator 6 frequency-divides the fundamental frequency signal sent from oscillator 4 and outputs a timing signal for time-serially controlling the respective blocks. Generator 6 also outputs chip enable signals CE4 and CE5 for controlling access of RAMs (Random Access Memories) 7 and 8 (to be described later). RAM 7 is a small-capacity Random Access Memory and stores timepiece data such as a present time, and data such as control data which is frequently accessed, and its arrangement will be described later in detail. RAM 8 is a large-capacity RAM for storing storage area data, as will be described later in detail.

RAMs 7 and 8 can be accessed when the chip enable signal (CE) goes to "H" (HIGH level). Key input section 9 consists of key switches S1 to S3 and key switch group 3, as shown in FIG. 1, and outputs a key input signal associated with the operated key.

ROM address controller 10 is adopted to designate an address of ROM 11, and supplies address data to ROM 11. ROM 11 is a Read Only Memory storing a microprogram for controlling the entire circuit of the present invention and various data. ROM 11 parallel-outputs microinstructions RA, D, OP, and NA based on the address data sent from controller 10. Microinstruction RA is an address signal for RAM 7, and is input to RAM 7 through data bus A.

Upon reception of microinstruction RA, RAM 7 outputs data at the address designated by microinstruction RA to display buffer 13, multiplexer 15 (to be described later), RAM 8, and the like. Microinstruction D consists of data information such as alphanumeric data and address information for RAM 8, and is output to RAM 8, RAM address controller 21, and multiplexer 15 through data bus B. Microinstruction OP is an operation code, and is sent to controller 16 through data bus C. Upon reception of microinstruction OP, controller 16 decodes the operation code and outputs control signal a to ROM address controller 10 to control it. In addition, controller 16 outputs control signals b and c to timing generator 6. Controller 16 also outputs various other control signals to other blocks.

Timing generator 6 receives control signals b and c and generates, based on these signals, chip enable signals CE4 and CE5 and a timing control signal supplied to the respective blocks.

Microinstruction NA is next address data for the microprogram stored in ROM 11, and is output to ROM address controller 10 and is then supplied to ROM 11 therethrough.

Multiplexer 15 selects data sent through data bus A based on a control signal (not shown) sent from timing generator 6 or controller 16, and outputs the selected data to arithmetic logic unit (ALU) 17 through data bus D or register 18 through data bus E. Register 18 outputs temporarily stored data to ALU 17 through data bus F synchronously with data output from multiplexer 15 through data bus E. ALU 17 performs an arithmetic logic operation of data input from multiplexer 15 and register 18 respectively through data buses D and E, and outputs the processed data to an internal register of RAM 7 through data bus G.

Address counter 19 is an address addition circuit for RAM 7, which is used in processing, for accessing a plurality of data at successive addresses in RAM 7, such as alarm detection processing for comparing the present time and an alarm time. Address counter 19 adds the address value of microinstruction RA input from ROM 11 through data bus A, and sends back the sum data to ROM 7 through data bus A. RAM address controller 21 is a circuit for controlling the addresses of RAM 8, and supplies address data to RAM 8 based on microinstruction D sent from ROM 11. Buzzer driver 20 receives the buzzer drive signal of a predetermined frequency from frequency divider 5 through data bus G, and causes a buzzer to produce a buzzer sound based on control signal d sent from divider 5.

The principal internal arrangements of RAMs 7 and 8 will now be described with reference to FIGS. 3A to 3C and 4.

Figure 3A:
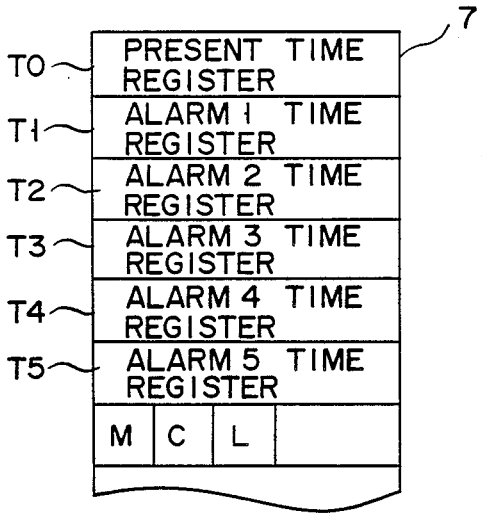
FIG. 3A is a map showing an internal arrangement of RAM 7 shown in FIG. 2.
Figure 3B:
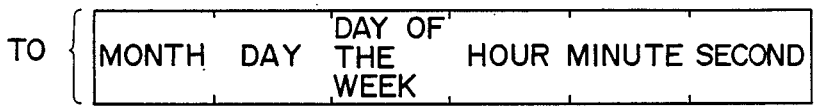
FIG. 3B is a map showing, in detail, internal data of present time register T0 of RAM 7.
Figure 3C:
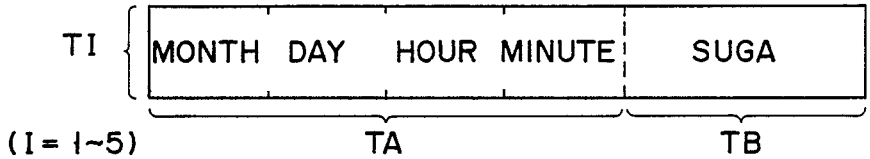
FIG. 3C is a map showing, in detail, internal data of an alarm time register of RAM 7.

FIG. 3A shows the internal arrangement of RAM 7. RAM 7 comprises present time register T0, alarm time register areas T1 to T5, mode flag M for storing various display modes, timer count register C, pointer L, and the like. Present time register T0 stores present time data (i.e., month, day, day of the week, hour, minute, second, and the like), as shown in FIG. 3B showing the storage content. Each of alarm time register areas T1 to T5 is constituted by area TA for storing month, day, hour, and minute data of an alarm time and area TB for storing at least part of data stored in a data storage area of RAM 8 (to be described later), e.g., name data (MR. SUGA), as shown in FIG. 3C showing the storage content of register TI. Five alarm time registers, i.e., alarm 1 time register T1 to alarm 5 time register T5 are arranged. Mode flag M stores 0 in a time display mode, 1 in a data storage area display mode, and 2 in an alarm time display mode. Timer count register C is used for timer count after alarming processing. Pointer L stores digit address data of month, day, hour and minute digits stored in alarm time register area TA.

Figure 4:
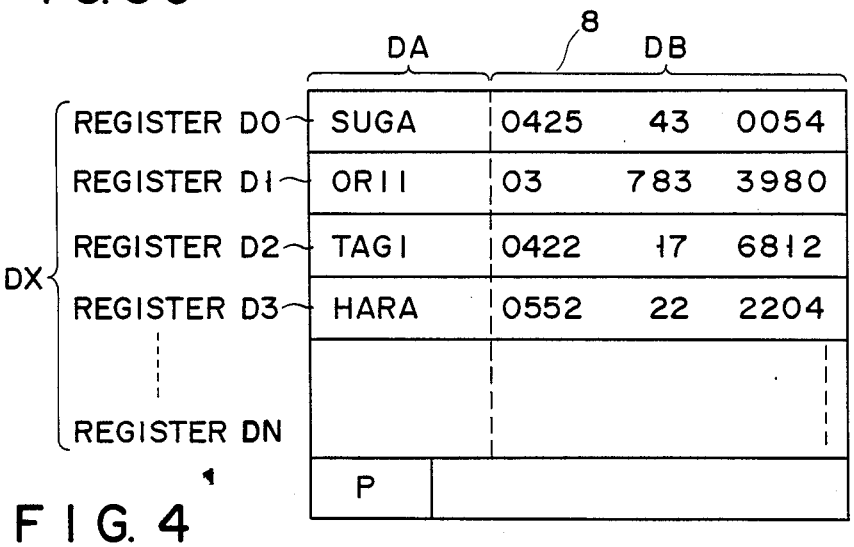
FIG. 4 is a map showing an internal arrangement of RAM 8 shown in FIG. 2.

FIG. 4 shows the internal arrangement of RAM 8. RAM 8 is constituted by item data storage area Dx consisting of registers D0, D1, . . . for storing item data such as a telephone memorandum, schedule memorandum, and the like, and pointer P for storing page address data in item data storage area Dx at which predetermined data is stored. Each register of item data area Dx consists of name storage area DA for storing name data, and telephone number storage area DB for storing telephone number data. For example, in first item data area D0, name data "Mr. SUGA" is stored in name storage area DA, and corresponding telephone number data "0425-43-0054" is stored in telephone number storage area DB. Similarly, in register D1, name data "MR. ORII" and corresponding telephone number data "03-783-3980" are stored. In register D2, name data "MR. TAGI" and corresponding telephone number data "0422-22-6812", and in register D3, name data "MR. HARA" and corresponding telephone number data "0552-22-2204" are stored. Data DI in data storage area Dx are accessed upon operation of key switches S1 to S3, and have lower access frequency than that of time data.

Figure 5A:
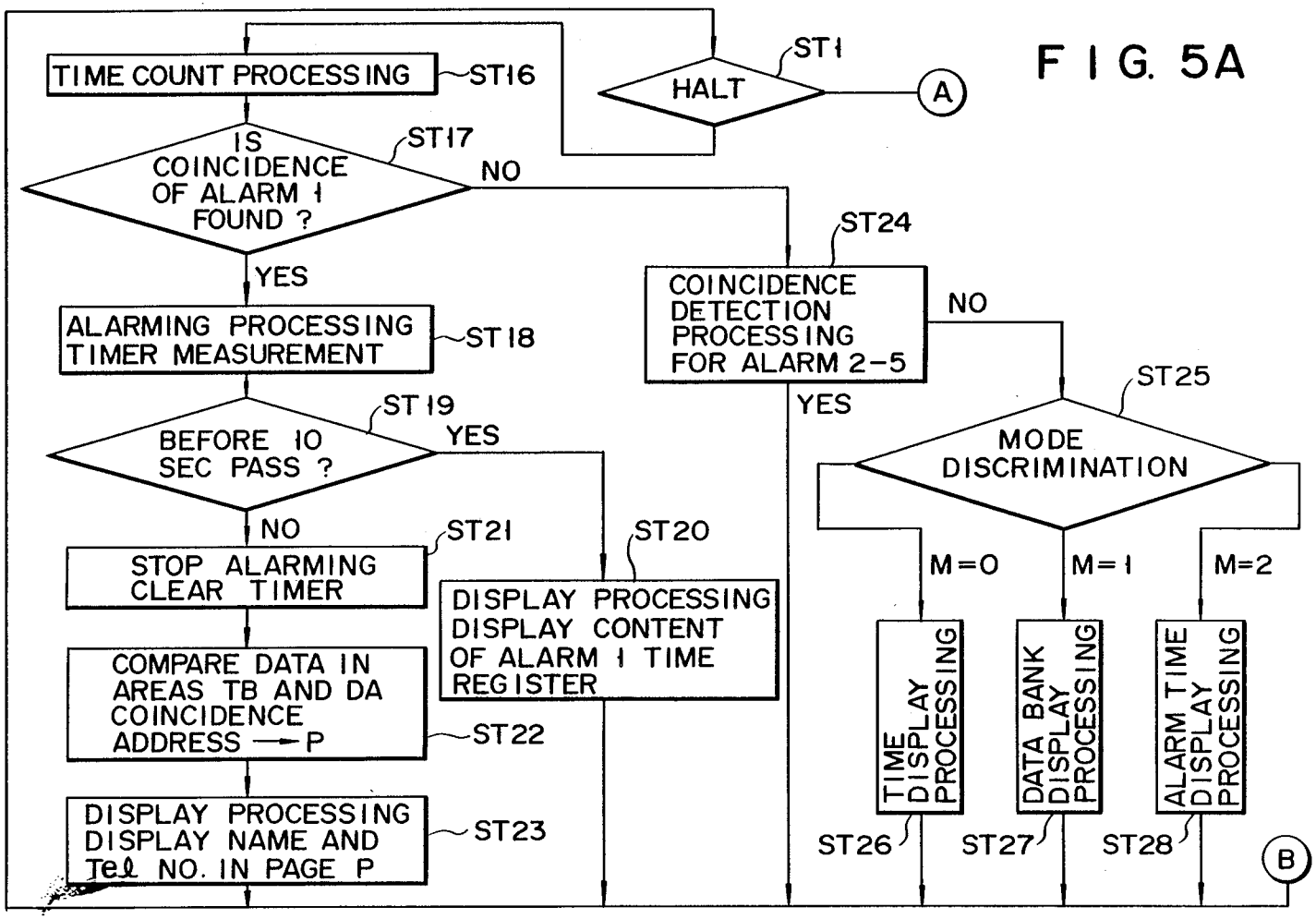
FIGS. 5A and 5B are flow charts showing the sequence of processing of this embodiment.
Figure 5B:
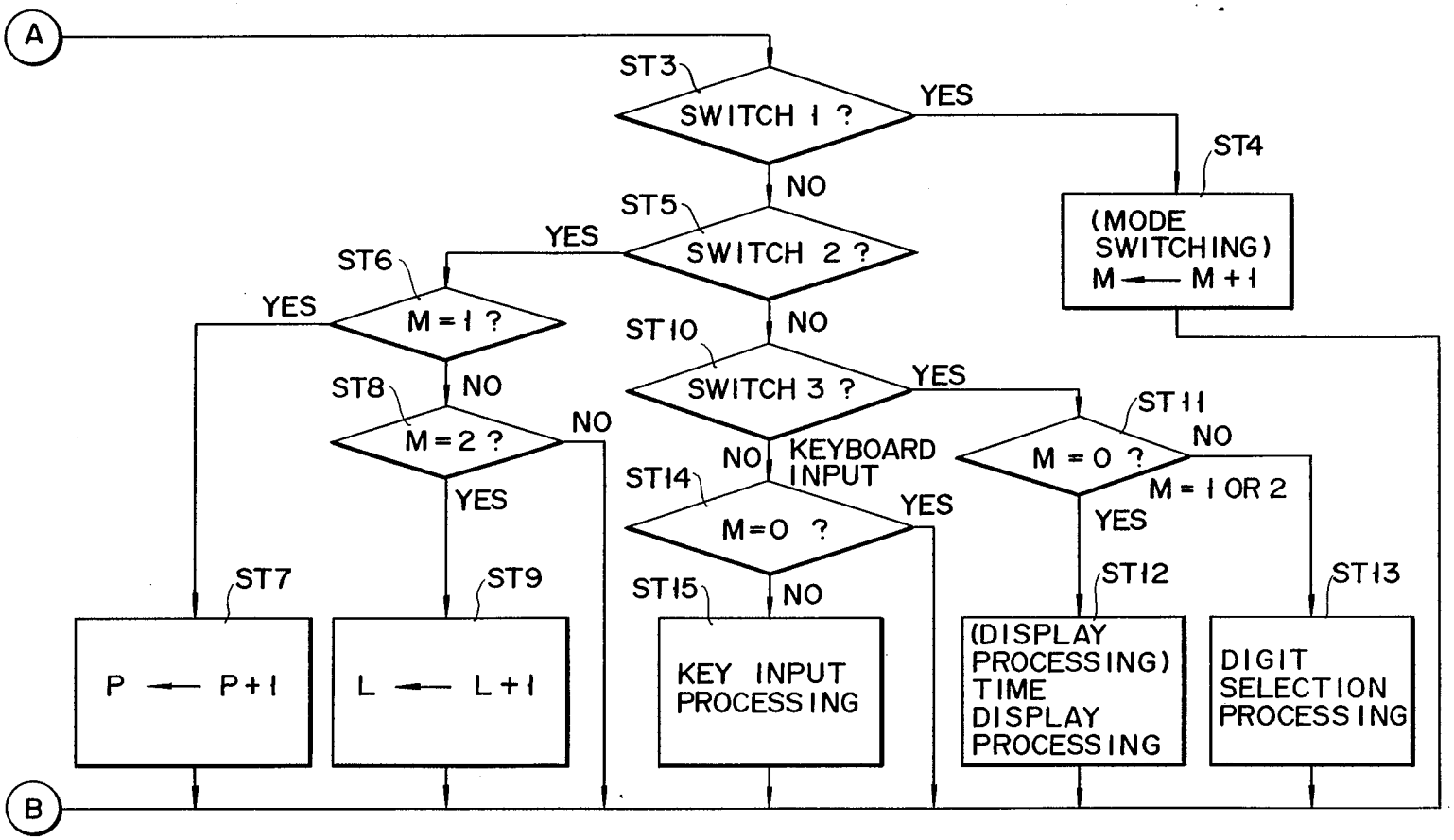
Figure 6:
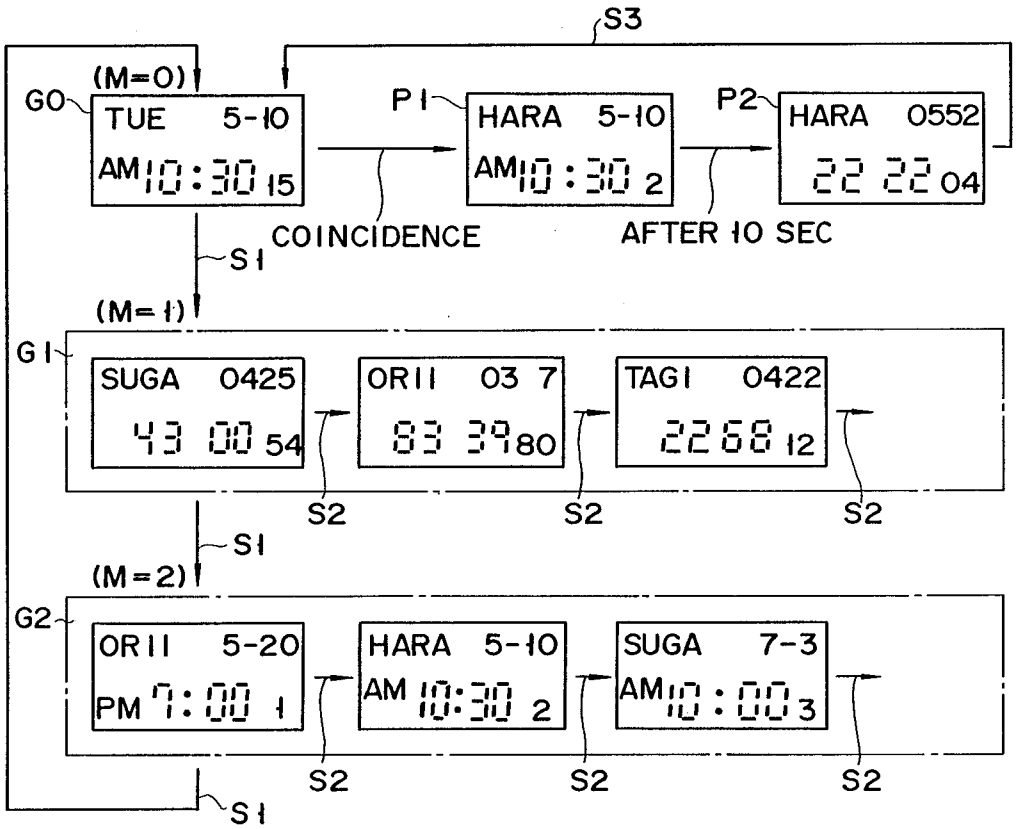
FIG. 6 is a view showing various display states on a display section based on the operation of key switches.

FIGS. 5A and 5B are flow charts of the entire system processed in accordance with the microprogram stored in ROM 11. FIG. 6 shows display states of display section 2 which are changed upon operation of key switches S1 to S3 or when an alarm time is reached the present time. The operation of the present invention will now be described with reference to FIGS. 5A, 5B, and 6.

Referring to FIG. 5A, step ST1 shows a HALT state. When a 1/16-sec signal is output from frequency divider 5 (FIG. 2) in this state, the flow advances to step ST16 to execute time counting processing. When a key is operated in the HALT state in step ST1, the flow advances to step ST3 shown in FIG. 5B. It is checked in step ST3 if the operated key switch is switch S1. If YES in step ST3, the flow advances to step ST4, and the value of mode flag M of RAM 7 is incremented by one (if M=2, it is reset to M=0), thus performing mode switching processing.

More specifically, in steps ST3 and ST4, a display mode is switched upon operation of key switch S1. G0 in FIG. 6 represents a display state in a display mode when mode flag M=0, i.e., the time display mode. The content of present time register T0 of RAM 7, i.e., May 10, Tuesday, AM 10 : 30 : 15, is displayed. When switch S1 is operated in the state of M=0, the value of M is updated to M+1 by steps ST3 and ST4, as shown in FIG. 5B, and the display mode is sequentially switched to data storage area display mode G1 (M=1), and alarm time display mode G2 (M=2), and then returns to time display mode G0 (M=0).

If NO in step ST3 in FIG. 5B, the flow advances to step ST5 to check if key switch S2 is operated. If YES in step ST5, it is checked in step ST6 if mode flag M=1 (data storage area display mode). If YES in step ST6, the content of pointer P of RAM 8 is incremented by one in step ST7. More specifically, in this case, as shown in FIG. 6, each time key switch S1 is operated in data storage area display mode G1 (M=1), the content of the data storage area is displayed in the order of page addresses. In FIG. 6, name data "MR. SUGA", "MR. ORII", and "MR. TAGI", and their corresponding telephone numbers are selectively displayed upon operation of key switch S2. If NO in step ST6, it is checked in step ST8 if mode flag M=2 (alarm time display mode G2). If YES in step ST8, the flow advances to step ST9, and the content of pointer L of RAM 7 is incremented by one. More specifically, in alarm time display mode G2 (M=2), each time key switch S2 is operated, the contents of alarm time registers T1 to T5 are displayed in the order of addresses. In FIG. 6, alarm 1 data (May 20, PM 7 : 00, MR. ORII), alarm 2 data (May 10, AM 10 : 30, MR. HARA), and alarm 3 data (July 3, AM 10 : 00, MR. SUGA) are sequentially displayed.

It NO in step ST5 in FIG. 5B, it is checked in step ST10 if key switch S3 is operated. If YES in step ST10, it is checked to step ST11 if the time display mode (M=0) is selected. If YES in step ST11, display processing of time display mode G0 (M=0) is performed in step ST12 (FIG. 6). More specifically, in this processing, when the present time coincides with the alarm time nd the alarm time is displayed, the display of the present time is resumed upon operation of key switch S3. If NO in step ST11, the flow advances to step ST13, and digit selection processing is performed. In the digit selection processing, the digit of input data is sequentially selected upon operation of key switch S3 in the data bank or alarm time display mode (M=1 or 2). In NO in step ST10, the flow advances to step ST14, and input processing of key switch group 3 is allowed in step ST15 unless M=0. More specifically, new data can be set or updated at the digit selected in step ST13 upon operation of key switch group 3 in the data storage area or alarm time display mode (M=0 or 2).

When a user wishes to call a desired person at a given alarm time, he can set the alarm time as follows.

First, key switch S1 is operated in present time display mode G0 in FIG. 6 to switch the display in data storage area display mode G1. Next, key switch S3 is operated to display data in RAM 8 and to check if a name and telephone number of a person to be called are stored.

If it is confirmed that the destination name and telephone number are stored, switch S1 is operated again to switch the display in alarm time display mode G2 (M=2). Then, key switch S3 is operated to select digits in step ST13. Keyboard 3 is operated to input desired data at the selected digit in step ST15.

In this case, digit selection by key switch S3 is performed in the order of month, day, hour, minute of an alarm time, and name. The selected digit is indicated by flashing. G2 in FIG. 6 represents the state wherein name data "MR. OII", "MR. HARA", and "MR. SUGA" are respectively set in alarm 1, alarm 2, and alarm 3.

The alarm time set in this manner is compared with the present time. When the present time coincides with the alarm time, not only the preset name data but also a telephone number which is not set are displayed. The operation will now be described below.

When a 1/16-sec signal is output from frequency divider 5 (FIG. 2) in the HALT state in step ST1 in FIG. 5A, time count processing is executed in step ST16. In the time count processing, the present time data (month, day, day of the week, hour, minute, second, and the like) is updated. The flow then advances to step ST17, and alarm detection processing is executed to detect if the alarm time stored in alarm 1 time register T1 coincides with the present time stored in present time register T0. If YES in step ST17, alarming processing for signaling an alarm time by a buzzer sound through buzzer driver 20 and timer processing for starting timer C of RAM 7 are executed in step ST18. Before 10 seconds pass in timer C in step ST19, the flow advances to step ST20, and display processing of the alarm 1 time register is performed. In the display processing in step ST20, the data stored in the alarm 1 time register is sent to the display section and is displayed. If it is determined in step ST19 that 10 seconds have passed in timer C, the alarming processing is stopped in step ST21, and timer C is cleared. The flow then advances to step ST22 to compare name data stored in name storage area TB in alarm 1 time register T1 with data in name storage area DA of each page in data storage area Dx of RAM 8. If a coincidence is established, the page address of corresponding name storage area DA is input to pointer P, and display processing is performed in step ST23. In the display processing step ST23, data in name storage area DA at a page address designated by pointer P and data in area DB indicating a telephone number are set to the display section and are displayed.

If the alarm time of alarm 1 time register T1 does not coincide with the present time in step ST17, coincidence detection processing between alarm times stored in other alarm time registers (alarm 2 time register T2 to alarm 5 time register T5) and the present time is performed in step 24. If a coincidence is established, the same processing in steps ST18 to ST23 is executed. If no coincidence is detected, the display mode is discriminated to step ST25, and time display, data storage area display and alarm time display processing operations are executed insteps ST26, ST27, and ST28 in correspondence with display mode M=0, 1, and 2.

P1 in FIG. represents a display state when the alarm time of alarm 2 time register T2 coincides with the present time, and the content of alarm 2 time register T2 (May 10, AM 10 : 30, "MR. HARA") is displayed. When this state continues for 10 seconds, searching is performed to detect if name data "MR. HARA" of alarm 2 time register T2 is stored in storage area DA of RAM 8. If it is determined from the result of the search operation that the desired data is stored, name data "MR. HARA" and corresponding telephone number in RAM 8 are displayed, as shown in P2 in FIG. 6. When key switch S3 is operated in the display state of P2, the present time display mode is resumed in steps ST11 and ST12 in FIG. 5B.

In the above embodiment, name data need only be set in correspondence with an alarm time. When the alarm time is reached, the corresponding telephone number can also be displayed. Therefore, a cumbersome switch operation is not required, resulting in much convenience.

Note that name data stored in correspondence with the alarm time need not be a full name but may be an initial of a person.

FIGS. 7 to 10 show another embodiment of the present invention.

FIG. 7 shows the content of RAM 8 in FIG. 2. In FIG. 7, name data and corresponding telephone number are stored in each row such that name data "MR. SUGA" and his telephone number are stored in the first page, name data "MR. ORII" and his telephone number are stored in the second page, and the like, and a page is designated by pointer P.

FIG. 8 shows the content of alarm time register TI of RAM 7. In this case, storage area TA stores an alarm time, and storage area TB stores a page number of RAM 8 described above.

Figure 9:
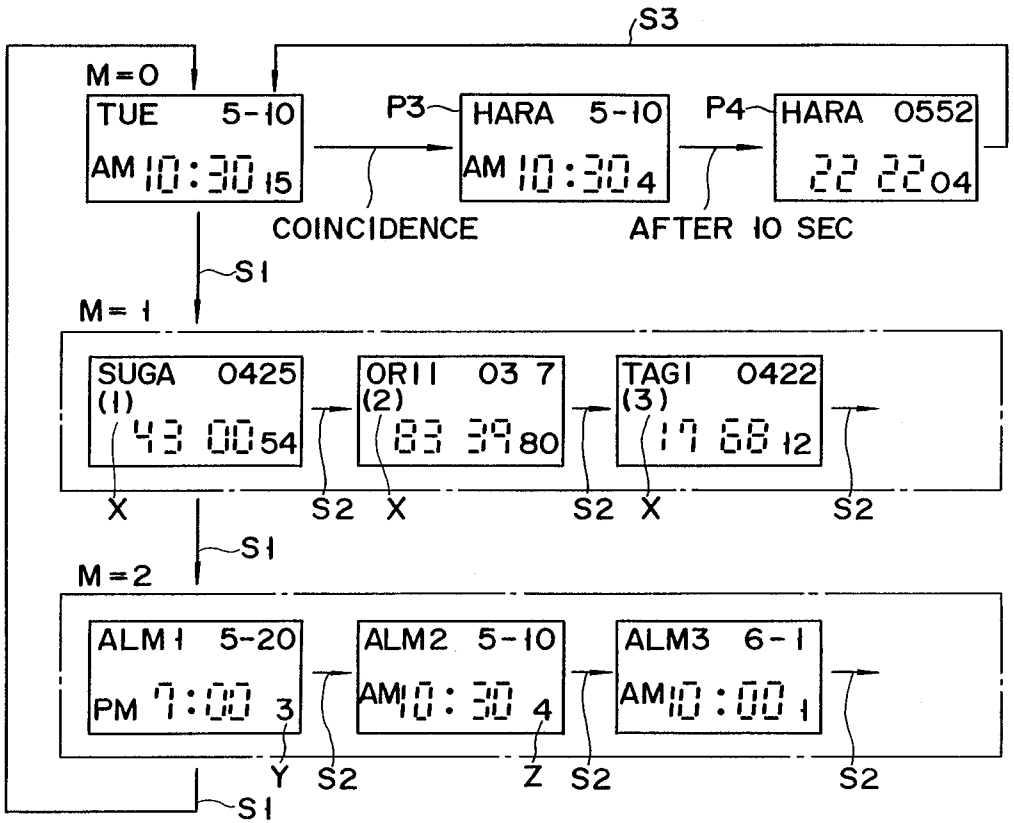
FIG. 9 is a view showing display states of the second embodiment.

FIG. 9 shows a change in display states based on the switch operation, and is substantially the same as that in FIG. 6. However, in data storage area display mode G1, when name data and telephone number data for each page are displayed, data of pointer P, i.e., page number X is displayed at the same time.

When the alarm time is set, the user checks the page number displayed in correspondence with desired name data in data storage area display mode G1, and sets the page number in the alarm time set mode. For example, in alarm 1, when a user wishes to call MR. TAGI at PM 7 : 00 on May 20, page number (3) of MR. TAGI is set, as indicated by Y in FIG. 9. If the user wishes to call MR. HARA at AM 10 : 30 on May 10, page number (4) of MR. HARA is set, as indicated by Z in FIG. 9.

Figure 10:
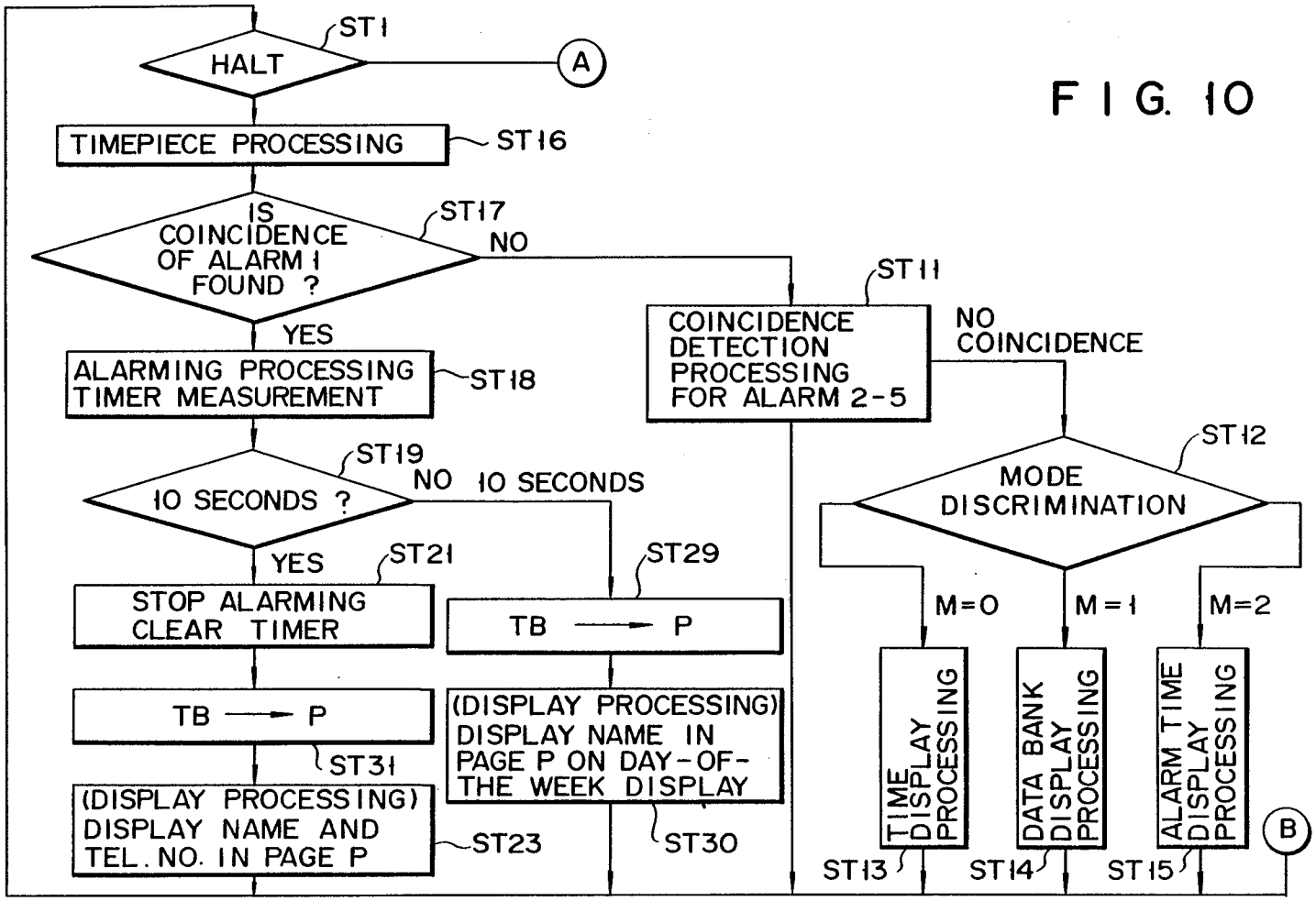
FIG. 10 is a flow chart showing processing sequence of the second embodiment.

In this case, the coincidence detection operation and the display operation of the telephone number are performed as shown in FIG. 10.

FIG. 10 is substantially the same as FIG. 5A, except that step ST20 in FIG. 5A is replaced with steps ST29 and ST30, and step ST22 in FIG. 5A is replaced with step ST31. FIG. 5B is followed by steps in FIG. 10.

More specifically, the content of the alarm time register is directly displayed in step ST20 in FIG. 5. However, in this embodiment, since no name data is stored in the alarm time register, the page number stored in storage area TB of the alarm time register is transferred to pointer P of RAM 8 in step ST29, and name data indicated by pointer P is read out in step ST30 to be displayed on display section 2. For example, name data "MR. HARA" is displayed on the display section 2, as indicated by P3 in FIG. 9.

It is checked in step ST22 in FIG. 5A if the name data set in storage area TB of the alarm time register TI is stored in RAM 8. In FIG. 10, since the page number of RAM 8 is set in storage area TB, the page number stored in storage area TB is transferred to pointer P of RAM 8 in step ST30.

In next step ST23, the page stored in pointer P is address-designated to display the name data and telephone number in the designated page on display section 2.

As a result, name data "MR. HARA" and his telephone number are displayed as indicated by P4 in FIG. 9.

Figure 11:
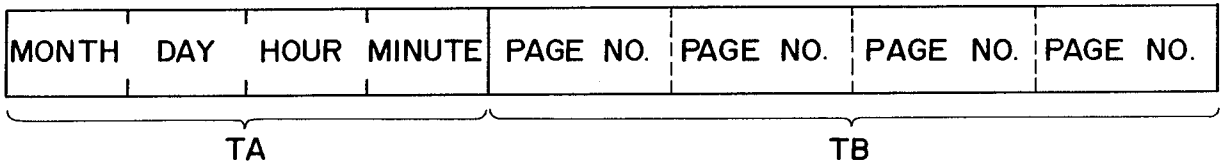
FIG. 11 is a map showing an example of a storage content of an alarm time register according to still another embodiment of the present invention.
Figure 12:
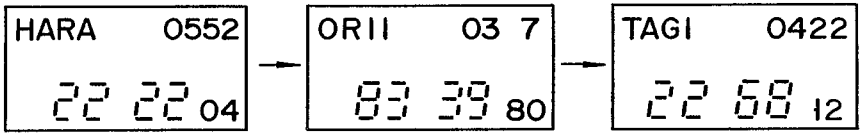
FIG. 12 is a view showing display states of the embodiment shown in FIG. 11.

FIGS. 11 and 12 show still another embodiment of the present invention. FIG. 11 shows the content of the alarm time register. The alarm time register can store a plurality of pages of RAM 8 in correspondence with a single alarm time. When the alarm time is reached, names and telephone numbers of persons corresponding to the stored page number are sequentially displayed upon operation of a switch (not shown).

Of course, storage area TB may store "name" as in the first embodiment.

Figure 13:
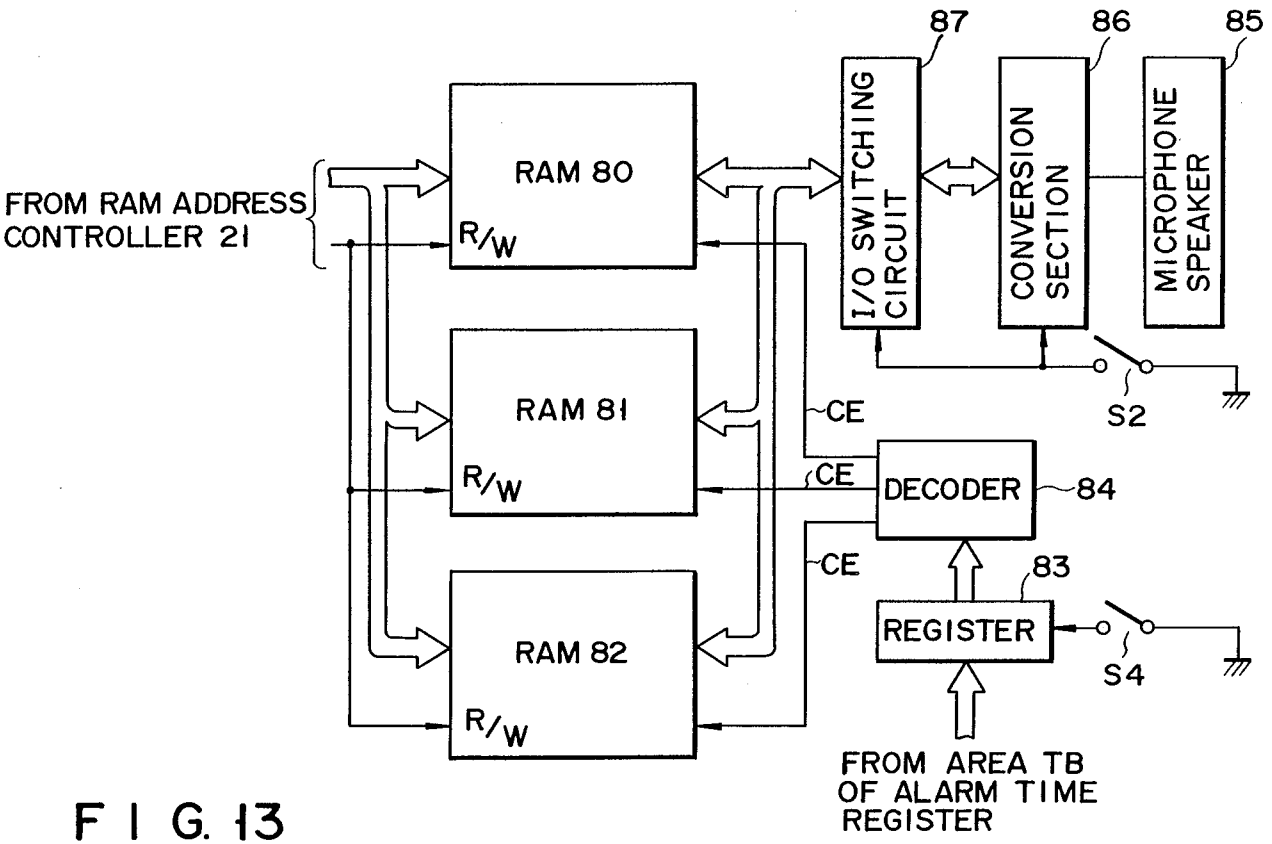
FIG. 13 is a circuit diagram of a RAM 8 portion shown in FIG. 1 according to still another embodiment of the present invention.

FIG. 13 shows still another embodiment of the present invention. More specifically, in FIG. 2, data such as a name and a telephone number is stored in RAM 8, and the data is displayed at the alarm time. If RAM 8 is replaced with the arrangement shown in FIG. 13, prerecorded voice data can be reproduced at the alarm time.

Referring to FIG. 13, RAMs 80, 81, and 82 are arranged, and can store three types of voice data. RAMs 80, 81, and 82 are switched upon operation of selection switch S4. The operation signal from switch S4 is counted by 3-scale of register 83, and is then decoded by decoder 84. Then, chip enable signal CE is output to any of RAMs 80, 81, and 82 to select it.

Voice data can be recorded in the selected RAM if switch S5 is operated during speech input. An external speech is converted to voice data by conversion section 86 consisting of an amplifier, a low-pass filter, an A/D converter, a D/A converter, and the like, through microphone speaker 85, and the voice data is supplied to I/O switching circuit 87. Then, the voice data is written in the selected RAM. Conversion section 86 and I/O switching circuit 87 input external data while switch S5 is being operated.

The alarm time register consists of storage areas TA and TB as shown in FIG. 8. Storage area TA stores an alarm time, and area TB stores selection data of any of RAMs 80, 81, and 82, i.e., 0, 1, or 2.

When the alarm time coincides with the present time, a value in storage area TB is preset in register 83, and the chip enable signal is supplied to the RAM corresponding to the preset value. Since a read signal and a RAM address update signal are supplied from RAM address controller 21, voice data is read out from the RAM which receives the chip enable signal. Then, the voice signal is supplied to the microphone speaker through I/O switching circuit 87 and conversion section 86 and is reproduced.

The various embodiments of the present invention have been described. However, the present invention is not limited to the above embodiments.

For example, in the above embodiment, alarm data and memorandum data storage means is divided into RAMs 7 and 8 to reduce a power consumption. The alarm-time and memorandum data may be stored in separate areas of a single storage means.

The memorandum data which can be applied to the present invention is not limited to a name and a telephone number. For example, the memorandum data may include schedule data such as a place and content of a meeting.

The content of data area TB in correspondence with the alarm time (TA) may be any data if at least part of corresponding data in other data storage areas can be designated.

In the above embodiments, the present invention is applied to an electronic wristwatch but can be applied to a table watch. Also, the present invention can be applied to a timepiece device of a compact electronic calculator having a timepiece function. The apparatus of the present invention may be installed in an IC card or various other equipment.

What is claimed is:

1. An electronic timepiece, comprising:

time count means for counting a reference signal to obtain present time data;

converting means for converting an external speech sound into voice data and for outputting the converted voice data;

voice data storage means, having a plurality of storage areas, for storing said voice data outputted by said converting means in said plurality of storage areas;

alarm time data storage means for storing alarm time data and designation data for designating at least one of said plurality of storage areas, said designation data designating a smaller number of said storage areas of said voice data storage means than said plurality of storage areas in which said voice data is stored;

read control means for detecting a coincidence between present time data obtained by said time counter means and said alarm time data stored in said alarm time data storage means and for reading out the voice data from the at least one storage area designated by said designation data; and sound generating means for generating speech corresponding to said voice data read out by said read control means.

2. The electronic timepiece according to claim 1, wherein said voice data storage means comprises a random access memory.

3. The electronic timepiece according to claim 1, further comprising selecting means for selecting one of said plurality of storage areas; and wherein said voice data outputted by said converting means is stored in a storage area which is selected by said selecting means.

4. The electronic timepiece according to claim 3, wherein said selecting means comprises:

an external operation switch means for producing an operation signal when it is operated; and counting means for counting the operation signals from said external operation switch means.

5. The electronic timepiece according to claim 1, wherein said read control means comprises a read only memory for storing a microprogram.

6. The electronic timepiece according to claim 1, wherein said designation data which is stored in said alarm time data storage means is numeric data.

* * * * *